US009874119B2

(12) United States Patent
Kim et al.

(10) Patent No.: US 9,874,119 B2
(45) Date of Patent: Jan. 23, 2018

(54) CONTINUOUS VARIABLE VALVE DURATION APPARATUS AND ENGINE PROVIDED WITH THE SAME

(71) Applicant: Hyundai Motor Company, Seoul (KR)

(72) Inventors: Back Sik Kim, Osan-si (KR); Kyoung Pyo Ha, Seongnam-si (KR); In Sang Ryu, Incheon (KR); Ingee Suh, Yongin-si (KR); Kiyoung Kwon, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 118 days.

(21) Appl. No.: 14/941,204

(22) Filed: Nov. 13, 2015

(65) Prior Publication Data

US 2016/0160705 A1 Jun. 9, 2016

(30) Foreign Application Priority Data

Dec. 9, 2014 (KR) ..... 10-2014-0175842

(51) Int. Cl.

| | |
|---|---|
| ***F01L 1/14*** | (2006.01) |
| ***F01L 13/00*** | (2006.01) |
| ***F01L 1/047*** | (2006.01) |
| ***F01L 1/356*** | (2006.01) |

(52) U.S. Cl.

CPC ..... *F01L 13/0015* (2013.01); *F01L 1/047* (2013.01); *F01L 1/356* (2013.01); *F01L 2001/0471* (2013.01); *F01L 2013/0084* (2013.01)

(58) Field of Classification Search

CPC ..... F01L 1/047; F01L 2001/0471; F01L 13/0015; F01L 2013/0084

USPC ..... 123/90.16, 90.39, 90.44, 90.27, 90.31, 123/90.6

See application file for complete search history.

(56) References Cited

U.S. PATENT DOCUMENTS

| | | | | |
|---|---|---|---|---|
| 5,924,334 | A | 7/1999 | Hara et al. | |
| 6,684,836 | B2 | 2/2004 | Inoue | |
| 9,512,748 | B2 * | 12/2016 | Kim | F01L 1/356 123/90.16 |

FOREIGN PATENT DOCUMENTS

| | | | |
|---|---|---|---|
| DE | 103 06 154 | A1 | 8/2004 |
| EP | 0 940 594 | A1 | 9/1999 |
| GB | 1311562 | A | 3/1973 |
| JP | 2006-329131 | A | 12/2006 |
| JP | 2009-236010 | A | 10/2009 |
| JP | 2012-122436 | A | 6/2012 |

(Continued)

*Primary Examiner* — Ching Chang

(74) *Attorney, Agent, or Firm* — Morgan Lewis & Bockius LLP

(57) ABSTRACT

A continuous variable valve duration apparatus may include a camshaft mounted to a cylinder head, a plurality of wheels mounted to the camshaft, of which a wheel key is formed respectively, and disposed on each cylinder, a plurality of cam portions of which a cam and a cam key are formed respectively, of which the camshaft is inserted thereto, of which relative phase angles with respect to the camshaft are variable, and disposed on the each cylinder, a plurality of inner brackets connected with the each wheel key and the each cam key, a plurality of slider housings of which the each inner bracket is rotatably inserted thereto, and disposed movable up and down direction of an engine, a guide shaft connecting the plurality of slider housings and a control portion moving a position of the guide shaft for changing rotation centers of the inner brackets.

17 Claims, 8 Drawing Sheets

(56) References Cited

FOREIGN PATENT DOCUMENTS

| | | | |
|---|---|---|---|
| KR | 10-1145633 | B1 | 5/2012 |
| KR | 10-2013-0063819 | A | 6/2013 |

* cited by examiner

CONTINUOUS VARIABLE VALVE DURATION APPARATUS AND ENGINE PROVIDED WITH THE SAME

CROSS-REFERENCE TO RELATED APPLICATION

The present application claims priority to and the benefit of Korean Patent Application No. 10-2014-0175842 filed on Dec. 9, 2014, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuous variable valve duration apparatus may include a camshaft mounted to a cylinder head, a plurality of wheels mounted to the camshaft, of which a wheel key is formed respectively, and disposed on each cylinder, a plurality of cam portions of which a cam and a cam key are formed respectively, of which the camshaft is inserted thereto, of which relative phase angles with respect to the camshaft are variable, and disposed on the each cylinder, a plurality of inner brackets connected with the each wheel key and the each cam key, a plurality of slider housings of which the each inner bracket is rotatably inserted thereto, and disposed movable up and down direction of an engine, a guide shaft connecting the plurality of slider housings and a control portion moving a position of the guide shaft for changing rotation centers of the inner brackets.

The continuous variable valve duration apparatus may further include a first pin of which a wheel key slot where the wheel key is slidably inserted thereto is formed thereto and a second pin of which a cam key slot where the cam key is slidably inserted thereto is formed thereto and wherein a first and a second sliding pin holes where the first pin and the second pin are inserted thereto respectively may be formed to the inner brackets respectively.

The first pin and the second pin may be formed as a circular cylinder shape and the first sliding pin hole and the second sliding pin hole may be formed for the first pin and the second pin to be rotated within thereto.

The wheel key slot of the first pin and the cam key slot of the second pin may be formed opposite direction.

Parts of the first sliding pin hole and the second sliding pin hole may be opened for movements of the wheel key and the cam key not to be interrupted.

The continuous variable valve duration apparatus may further include a bearing inserted between the slider housing and the inner bracket.

The continuous variable valve duration apparatus may further include a head cover mounted to the cylinder head, and a guide surface for guiding movement of the slider housing may be formed to the head cover.

The control portion may include a control shaft connected with the guide shaft, a control motor mounted to the head cover and a control gear engaged with the control shaft and driven by the control motor.

The continuous variable valve duration apparatus may further include a detecting sensor mounted to the head cover for detecting movement of the guide shaft.

The wheel may be connected with the camshaft through a connecting pin.

According to various aspects of the present invention, an engine may include a camshaft mounted to a cylinder head, a plurality of wheels mounted to the camshaft, of which a wheel key is formed respectively, and disposed on each cylinder, a plurality of cam portions of which a cam and a cam key are formed respectively, of which the camshaft is inserted thereto, of which relative phase angles with respect to the camshaft are variable, and disposed on the each cylinder, a plurality of inner brackets of which a first and a second sliding pin holes connected with the each wheel key and the each cam key are formed thereto, a plurality of slider housings of which the each inner bracket is rotatably inserted thereto, and disposed movable up and down direction of the engine, a guide shaft connecting the plurality of slider housings, a first pin of which a wheel key slot where the wheel key is slidably inserted thereto and rotatably inserted into the first sliding pin hole, a second pin of which a cam key slot where the cam key is slidably inserted thereto is formed opposite direction of the wheel key slot, and rotatably inserted into the second sliding pin hole and a control portion moving a position of the guide shaft for changing rotation centers of the inner brackets.

Parts of the first sliding pin hole and the second sliding pin hole may be opened for movements of the wheel key and the cam key not to be interrupted.

The engine may further include a bearing inserted between the slider housing and the inner bracket.

The engine may further include a head cover mounted to the cylinder head, and a guide surface for guiding movement of the slider housing may be formed to the head cover.

The control portion may include a control shaft connected with the guide shaft, a control motor mounted to the head cover and a control gear engaged with the control shaft and driven by the control motor.

The engine may further include a detecting sensor mounted to the head cover for detecting movement of the guide shaft.

The wheel may be connected with the camshaft through a connecting pin.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

Since the continuous variable valve duration apparatus may be applied as a module, thus the continuous variable valve duration apparatus may be easily mounted to an engine and productivity may be improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
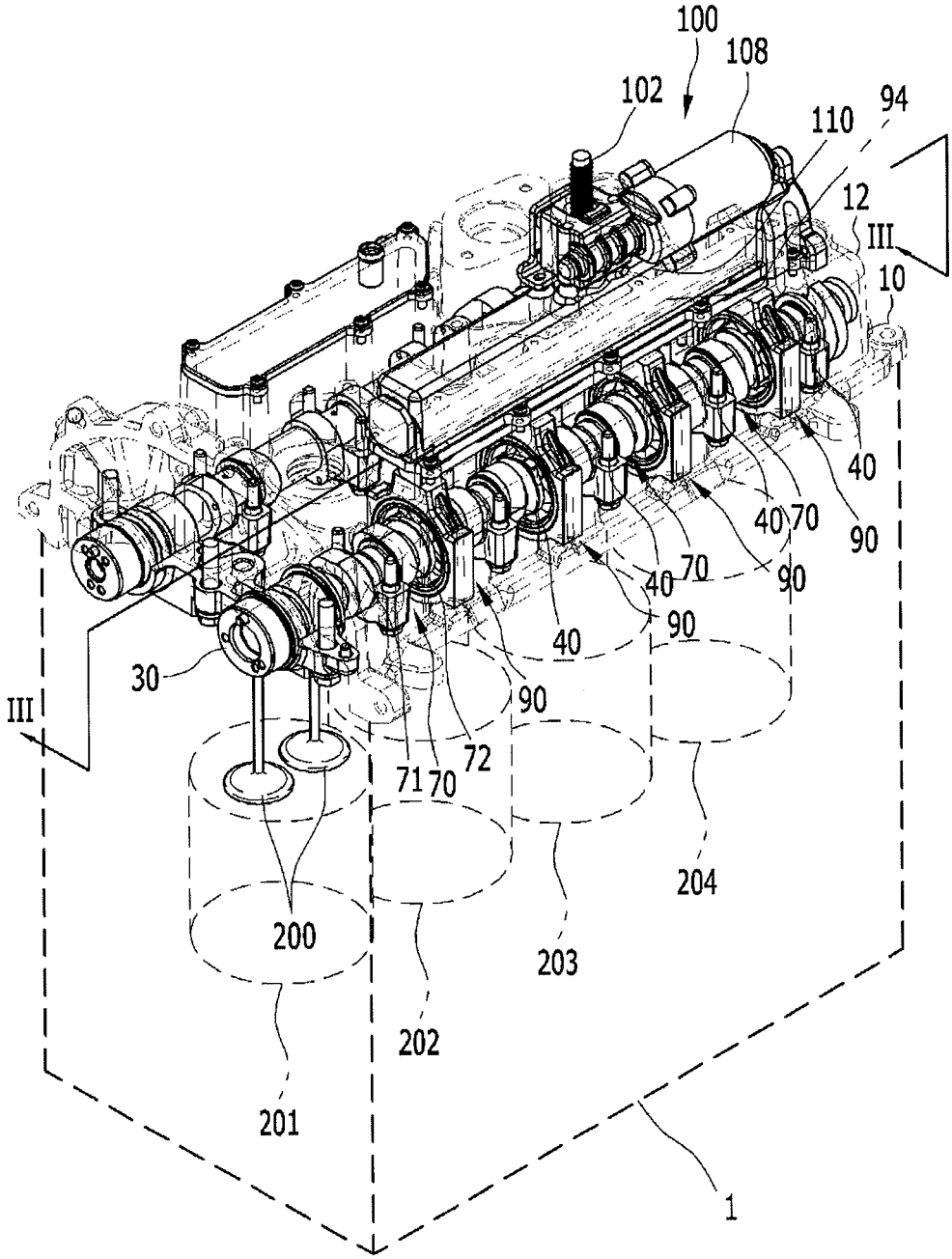
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
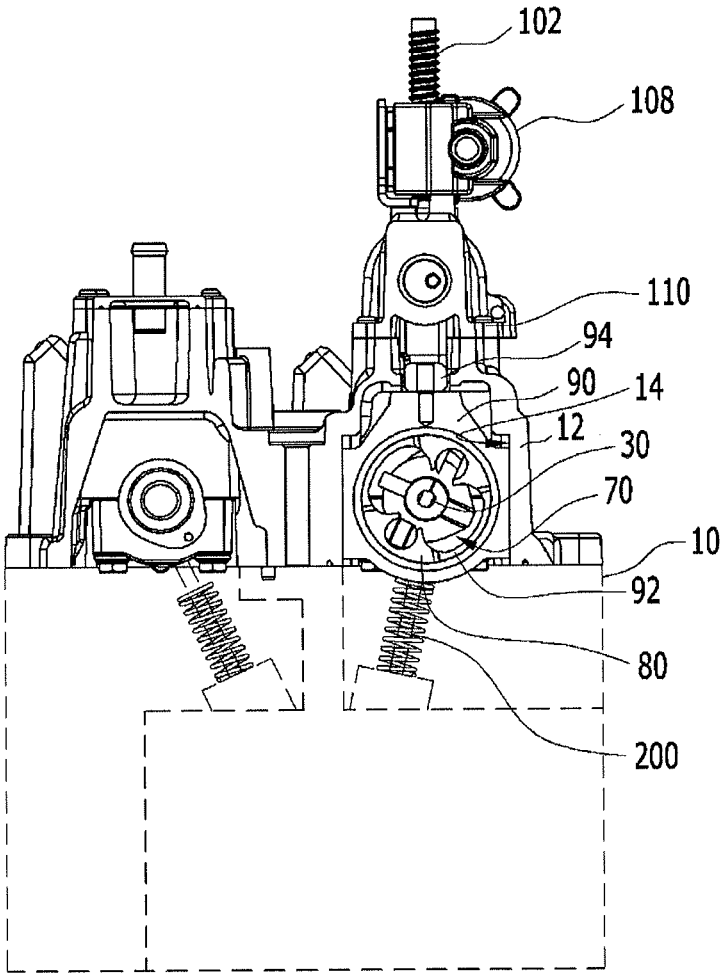
FIG. 2 is a front view of an engine provided with a continuous variable valve duration apparatus according to an exemplary embodiment of the present invention.

FIG. 1 is a perspective view of an engine provided with a continuous variable valve duration apparatus according to an exemplary embodiment of the present invention and FIG. 2 is a front view of an engine provided with a continuous variable valve duration apparatus according to an exemplary embodiment of the present invention.

Figure 3:
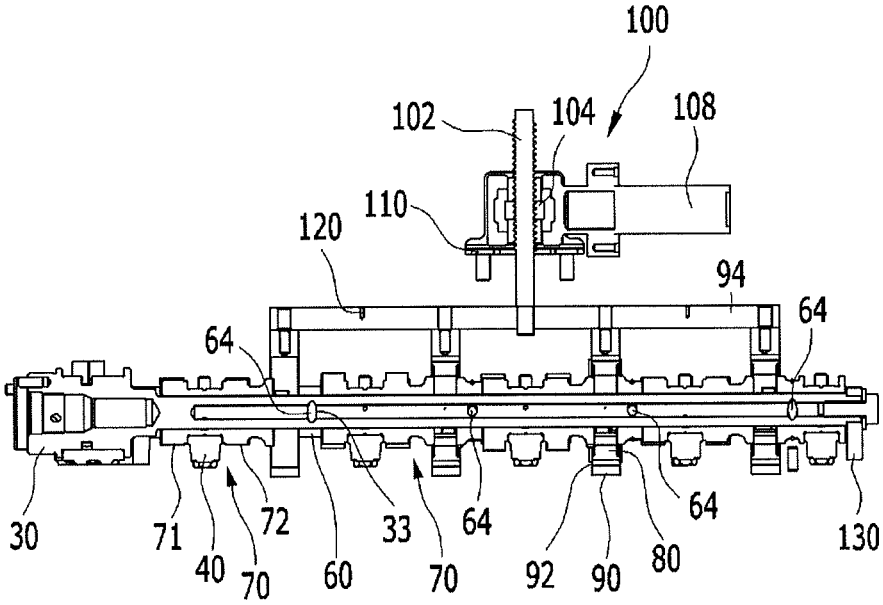
FIG. 3 is a partial cross-sectional view along line III-III of FIG. 1.
Figure 4:
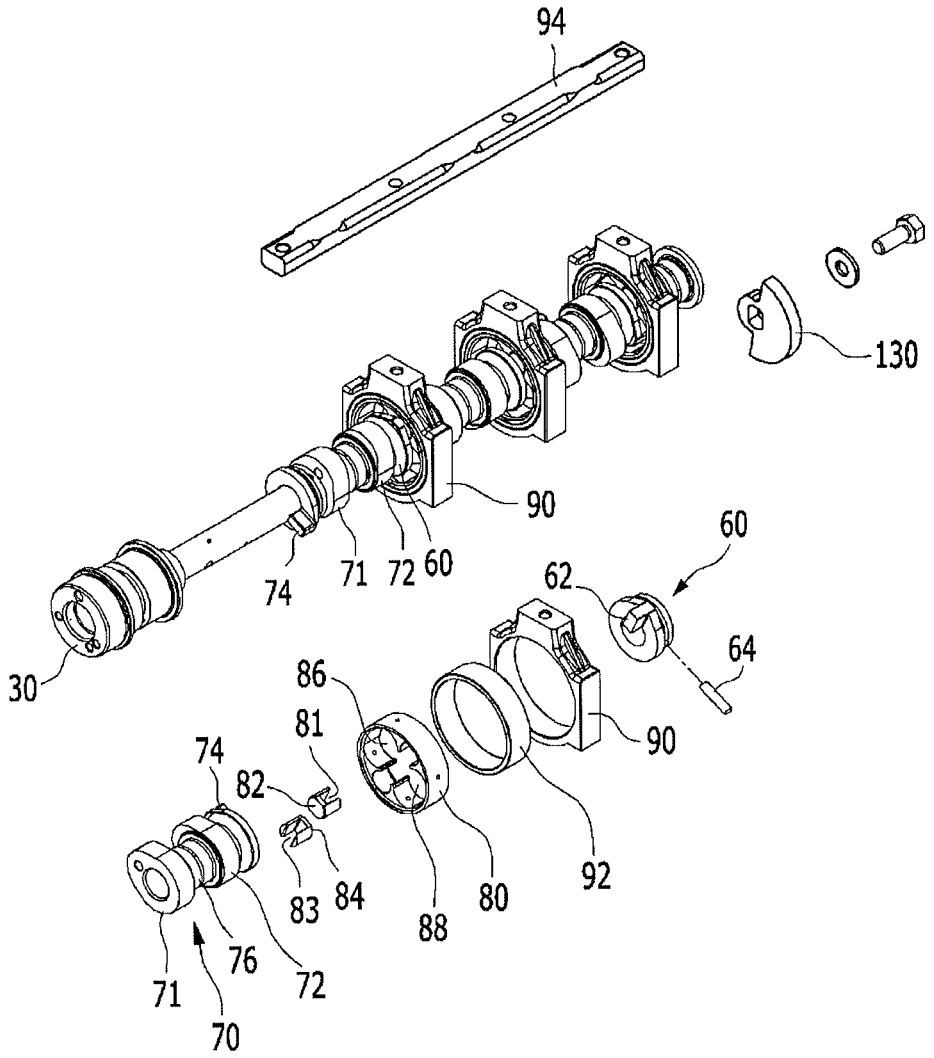
FIG. 4 is an exploded perspective view of a continuous variable valve duration apparatus according to an exemplary embodiment of the present invention.

FIG. 3 is a partial cross-sectional view along line III-III of FIG. 1 and FIG. 4 is an exploded perspective view of a continuous variable valve duration apparatus according to an exemplary embodiment of the present invention.

Referring to FIG. 1 to FIG. 4, an engine according to an exemplary embodiment of the present invention includes an engine block 1, and a cylinder head 10 disposed on the engine block 1 and a continuous variable valve duration apparatus mounted to the cylinder head 10.

In the drawings, the engine includes 4 cylinders 201, 202, 203 and 204, but is not limited thereto.

According to various aspects of the present invention, the continuous variable valve duration apparatus may include a camshaft 30 mounted to the cylinder head 10, a plurality of wheels 30 mounted to the camshaft 30, of which a wheel key 62 is formed respectively, and disposed on each cylinder 201, 202, 203 and 204, a plurality of cam portions 70 of which a cam 71 and/or 72 and a cam key 74 are formed respectively, of which the camshaft 30 is inserted thereto, of which relative phase angles with respect to the camshaft 30 are variable, and disposed on the each cylinder 201, 202, 203 and 204, a plurality of inner brackets 80 connected with the each wheel key 62 and the each cam key 74, a plurality of slider housings 90 of which the each inner bracket 80 is rotatably inserted thereto, and disposed movable up and down direction of the engine, a guide shaft 94 connecting the plurality of slider housings 90 and a control portion 100 moving a position of the guide shaft 94 for changing rotation centers of the inner brackets 80.

The camshaft 30 may be an intake camshaft or an exhaust camshaft.

The cams 71 and 72 contact to open valve 200.

The wheel 60 is connected to the camshaft 30 thorough a connecting pin 64.

The continuous variable valve duration apparatus further includes first pins 82 of which a wheel key slot 81, the each wheel key 62 is slidably inserted thereto, is formed thereto respectively and second pins 84 of which a cam key slot 83, the each the cam key 74 is slidably inserted thereto, is formed thereto respectively. And a first sliding pin hole 86 and a second sliding pin hole 88, of which the first pin 82 and the second pin 84 are inserted thereto respectively are formed to the inner bracket 80.

The first pin 82 and the second pin 84 are formed as a circular cylinder shape and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, thus wear resistance may be enhanced.

Also, productivity may be increased due to simple shapes of the first pin 82, the second pin 84, the first sliding pin hole 86 and the second sliding pin hole 88.

The wheel key slot 81 of the first pin 82 and the cam key slot 83 of the second pin 84 are formed opposite direction.

Parts of the first sliding pin hole 86 and the second sliding pin hole 88 are opened for movements of the wheel key 62 and the cam key 74 not to be interrupted.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

The continuous variable valve duration apparatus further include a head cover 12 mounted to the cylinder head 10, and a guide surface 14 for guiding movement of the slider housing 90 is formed to the head cover 12.

The control portion 100 include a control shaft 1002 connected with the guide shaft 94, a control motor 108 mounted to the head cover 12 and a control gear 104 engaged with the control shaft 102 and driven by the control motor 108.

The control motor 108 may be mounted to the head cover 12 through a mounting bracket 110.

The continuous variable valve duration apparatus further include a detecting sensor 120 mounted to the head cover 12 for detecting movement of the guide shaft 94. The detecting sensor 120 outputs detected signal to an ECU (Engine Control Unit), and the ECU determines a current position of the guide shaft 94 according to the detected signal and controls operations of the control motor 108 according to operation state of the engine.

A CPS wheel 130 is mounted to the camshaft 30 and outputs rotation signal of the camshaft 30 and the ECU may control operations of the engine and the continuous variable valve duration apparatus according to the rotation signal of the camshaft 30.

Figure 5:
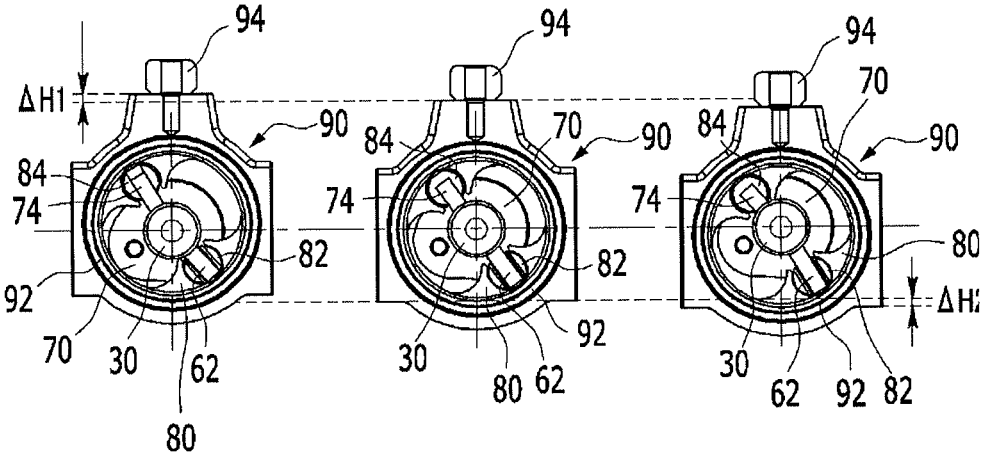
FIG. 5 is a drawing showing operation of a continuous variable valve duration apparatus according to an exemplary embodiment of the present invention.
Figure 6:
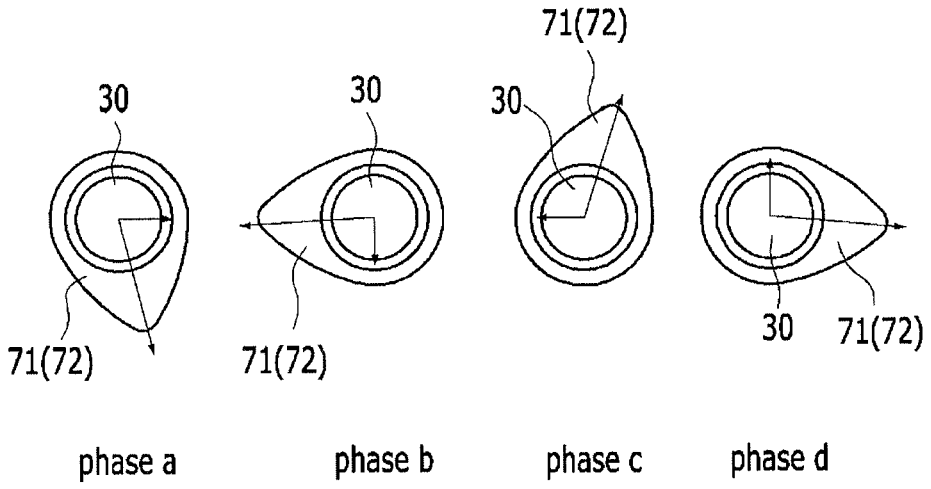
FIG. 6 and FIG. 7 are drawings showing mechanical motions of cams of a continuous variable valve duration apparatus according to an exemplary embodiment of the present invention.
Figure 7:
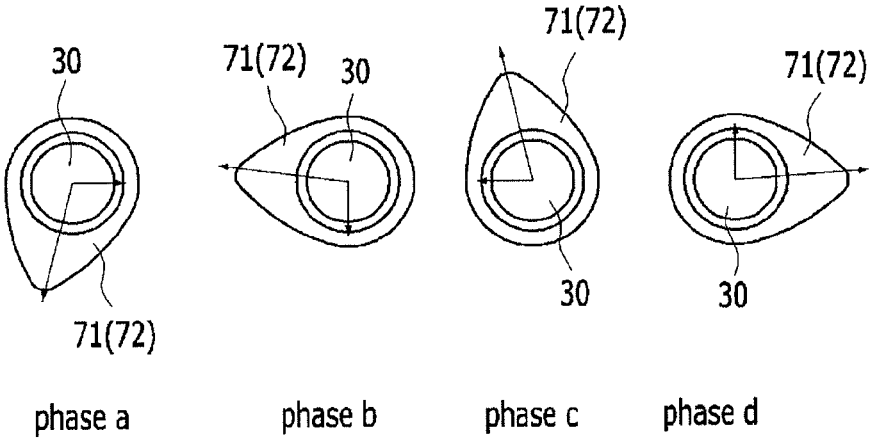

FIG. 5 is a drawing showing operation of a continuous variable valve duration apparatus according to an exemplary embodiment of the present invention, and FIG. 6 and FIG. 7 are drawings showing mechanical motions of cams of a continuous variable valve duration apparatus according to an exemplary embodiment of the present invention.

Referring to FIG. 1 to FIG. 7, operations of the continuous variable valve duration apparatus according to various exemplary embodiments of the present invention will be described.

According to engine operation states, the ECU transmits control signals to the motor 108 of the control portion 100 to change the relative position of the slider housing 90.

For example, when a rotation center of the inner bracket 80 coincides with a rotation center of the cam shaft 30, relative rotation speed changes between the cam 71 and 72 are not occurred. That is, the cam 71 and 72 and the cam shaft 30 rotates with same speed and same phase as a neutral state. When the motor 108 rotates the control shaft 102 for the slider housing 90 to be moved upward as $\Delta H1$, or when the motor 108 rotates the control shaft 102 for the slider housing 90 to be moved downward as $\Delta H2$, then the relative rotation center of the inner bracket 80 is changed.

When the rotation center of the inner bracket 80 is changed, angular acceleration of the cam portion 70 and valve duration are changed.

As shown in FIG. 6, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a. That is, the valve duration is changed.

As shown in FIG. 7, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 72 is relatively faster than rotation speed of the camshaft 30 from phase c to phase d and from phase d to phase a. That is, the valve duration is changed.

While the wheel 60 is rotated together with the camshaft 30, the wheel key 62 is slidable within the wheel key slot 81, the first pin 82 and the second pin 84 are rotatable within the first sliding pin hole 86 and the second sliding pin hole 88 respectively and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 8:
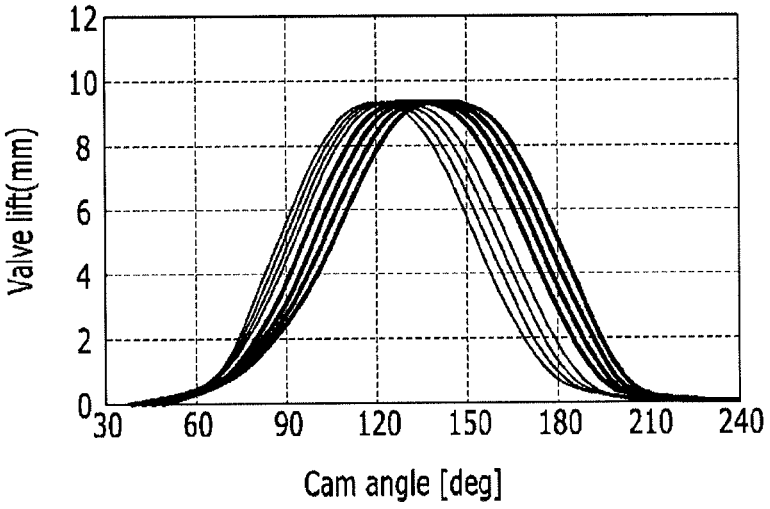
FIG. 8 is a graph of a valve profile of a continuous variable valve duration apparatus according to an exemplary embodiment of the present invention.

That is, as shown in FIG. 8, although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

While opening time of the valve 200 is constant, closing time of the valve 200 is changed in FIG. 8, it is not limited thereto. According to various mounting angle of the cams 71 and 72 and the valve 200, various contacting angles between cam lobe of the cams 71 and 72 and the valve 200 and so on, various valve duration may be performed.

Determinations of the control signals of the ECU according to the engine operation state is obvious to a person skilled in the art, thus detailed description will be omitted.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

Since the continuous variable valve duration apparatus may be applied as a module, thus the continuous variable valve duration apparatus may be easily mounted to an engine and productivity may be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft mounted to a cylinder head;

a plurality of wheels mounted to the camshaft, of which a wheel key is formed respectively, and disposed on each cylinder;

a plurality of cam portions of which a cam and a cam key are formed respectively, of which the camshaft is inserted thereto;

a plurality of inner brackets connected with each wheel key and each cam key;

a plurality of slider housings of which each inner bracket is rotatably inserted thereto, and disposed movable up and down direction of an engine;

a guide shaft connecting the plurality of slider housings; and a control portion configured for moving a position of the guide shaft for changing rotation centers of the plurality of the inner brackets.

2. The continuous variable valve duration apparatus of claim 1, further comprising:

a first pin of which a wheel key slot where the wheel key is slidably inserted thereto is formed thereto; and a second pin of which a cam key slot where the cam key is slidably inserted thereto is formed thereto; and wherein a first sliding pin hole and a second sliding pin hole where the first pin and the second pin are inserted thereto respectively are formed to the plurality of the inner brackets respectively.

3. The continuous variable valve duration apparatus of claim 2, wherein the first pin and the second pin are formed as a circular cylinder shape; and the first sliding pin hole and the second sliding pin hole are formed for the first pin and the second pin to be rotated within thereto.

4. The continuous variable valve duration apparatus of claim 3, wherein the wheel key slot of the first pin and the cam key slot of the second pin are formed opposite direction.

5. The continuous variable valve duration apparatus of claim 4, wherein parts of the first sliding pin hole and the second sliding pin hole are opened for movements of the wheel key and the cam key not to be interrupted.

6. The continuous variable valve duration apparatus of claim 1, further comprising a bearing inserted between the slider housings and the inner brackets.

7. The continuous variable valve duration apparatus of claim 1, further comprising:

a head cover mounted to the cylinder head, wherein a guide surface for guiding movement of the slider housings is formed to the head cover.

8. The continuous variable valve duration apparatus of claim 7, wherein the control portion comprises:

a control shaft connected with the guide shaft;

a control motor mounted to the head cover; and a control gear engaged with the control shaft and driven by the control motor.

9. The continuous variable valve duration apparatus of claim 7, further comprising a detecting sensor mounted to the head cover for detecting movement of the guide shaft.

10. The continuous variable valve duration apparatus of claim 1, wherein wheels are connected with the camshaft through a connecting pin.

11. An engine comprising:

a camshaft mounted to a cylinder head;

a plurality of wheels mounted to the camshaft, of which a wheel key is formed respectively, and disposed on each cylinder;

a plurality of cam portions of which a cam and a cam key are formed respectively, of which the camshaft is inserted thereto;

a plurality of inner brackets of which a first sliding pin hole and a second sliding pin hole connected with each wheel key and each cam key are formed thereto;

a plurality of slider housings of which each inner bracket is rotatably inserted thereto, and disposed movable up and down direction of the engine;

a guide shaft connecting the plurality of slider housings;

a first pin of which a wheel key slot where the wheel key is slidably inserted thereto and rotatably inserted into the first sliding pin hole;

a second pin of which a cam key slot where the cam key is slidably inserted thereto is formed opposite direction of the wheel key slot, and rotatably inserted into the second sliding pin hole; and a control portion configured for moving a position of the guide shaft for changing rotation centers of the plurality of the inner brackets.

12. The engine of claim 11, wherein parts of the first sliding pin hole and the second sliding pin hole are opened for movements of the wheel key and the cam key not to be interrupted.

13. The engine of claim 11, further comprising a bearing inserted between the slider housings and the inner brackets.

14. The engine of claim 11, further comprising:

a head cover mounted to the cylinder head, wherein a guide surface for guiding movement of the slider housings is formed to the head cover.

15. The engine of claim 14, wherein the control portion comprises:

a control shaft connected with the guide shaft;

a control motor mounted to the head cover; and a control gear engaged with the control shaft and driven by the control motor.

16. The engine of claim 14, further comprising a detecting sensor mounted to the head cover for detecting movement of the guide shaft.

17. The engine of claim 11, wherein the wheels are connected with the camshaft through a connecting pin.

* * * * *